United States Patent [19]

Lemercier et al.

[11] 4,357,764

[45] Nov. 9, 1982

[54] SUBMARINE VEHICLE FOR DREDGING AND RAISING MINERALS RESTING ON THE SEA BED AT GREAT DEPTHS

[75] Inventors: Pierre Lemercier, Saint Martin le Vinoux; Paul Marchal, Gif-sur-Yvette, both of France; Jean-Pierre Moreau, De Panne, Belgium; Jean Vertut, Issy les Moulineaux; Henri Ligozat, Saint Egreve, both of France

[73] Assignee: Commissariat a l'Energie Atomique, Paris, France

[21] Appl. No.: 142,046

[22] Filed: Apr. 21, 1980 (Under 37 CFR 1.47)

[30] Foreign Application Priority Data

Apr. 27, 1979 [FR] France ..... 79 10776

[51] Int. Cl.[3] ..... E21C 45/00; E02F 9/00

[52] U.S. Cl. ..... 37/54; 37/56; 37/69; 37/DIG. 8; 114/313; 114/321; 114/338

[58] Field of Search ..... 37/DIG. 8, 195, 54, 37/56, 58, 69; 114/312, 313, 321, 330–333, 337–338; 405/185, 191

[56] References Cited

U.S. PATENT DOCUMENTS

| | | | |
|---|---|---|---|
| 3,045,623 | 7/1962 | Tyler | 37/DIG. 8 |
| 3,220,372 | 11/1965 | Lehmann | 114/321 |
| 3,453,978 | 7/1969 | Shaler | 114/312 |
| 4,231,171 | 11/1980 | Balligand et al. | 37/DIG. 8 |
| 4,232,903 | 11/1980 | Welling et al. | 37/DIG. 8 |
| 4,280,288 | 7/1981 | Corfa et al. | 37/DIG. 8 |

FOREIGN PATENT DOCUMENTS

| | | | |
|---|---|---|---|
| 2377521 | 8/1978 | France | 37/DIG. 8 |

*Primary Examiner*—Clifford D. Crowder

*Attorney, Agent, or Firm*—Kerkam, Stowell, Kondracki & Clarke

[57] ABSTRACT

A submarine vehicle for collecting and raising materials resting on the sea bed at great depths, of the type comprising a load-bearing structure, collecting elements for the materials, storage silos for storing the materials collected and/or the ballast material, transfer means between said collecting elements and said silos, and main propellers for advancing the vehicle on the sea bed, said vehicle being characterized in that said load-bearing structure is made of a buoyancy material, said structure being in the form of a ring having a longitudinal plane of symmetry and defining the stem, stern and sides of said vehicle, and defining between them a free central space, the outer surface of said structure forming the hull of said vehicle, said storage silos being arranged in the free central space and fixed to said load-bearing structure, said collecting elements being arranged in front of and below said stem, said main propellers also being fixed to the lower surface of said load-bearing structure.

8 Claims, 10 Drawing Figures

FIG.2a
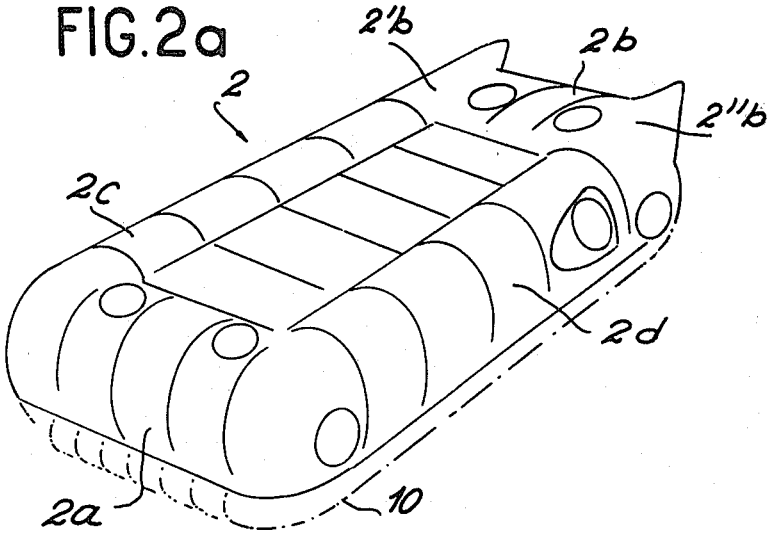
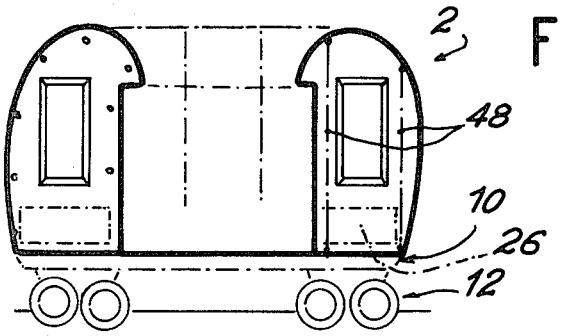
FIG.2c
FIG.2b
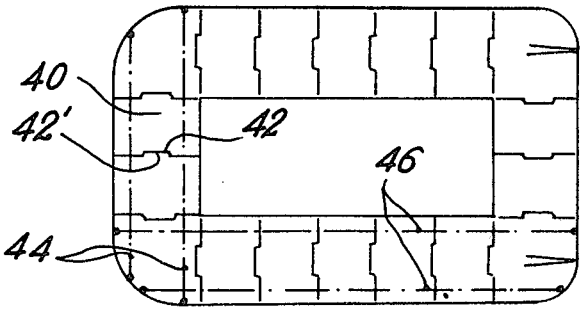

SUBMARINE VEHICLE FOR DREDGING AND RAISING MINERALS RESTING ON THE SEA BED AT GREAT DEPTHS

BACKGROUND OF THE INVENTION

This invention, which is the work of Mr. Jean-Pierre MOREAU of CHANTIERS FRANCE-DUNKERQUE and Messrs Pierre LEMERCIER, Henri LIGOZAT, Paul MARCHAL and Jean VERTU of the COMMISSARIAT A L'ENERGIE ATOMIQUE, relates to a submarine vehicle for dredging and raising minerals resting on the sea bed at great depths.

The dredging of minerals and in particular of polymetallic nodules and raising them to the surface from a great depth are generally carried out using two separate machines: on the one hand, the dredging machine, generally placed at the bottom of a long duct, and a hydraulic apparatus for raising the minerals collected in the duct to a surface support.

A process is known using collecting and raising machines. These machines are rendered heavy in relation to the ambient marine medium by the very great compression of gas in their ballasts, whilst the rest of the weight of the structures is compensated by known buoyancy products resistant to high pressure, which are required for the time spent at great depths. When the machine approaches the sea bed, the release of pressure of the gas contained in the ballast simultaneously provides the energy required for collection and for the travel of the vehicle on the sea bed. This pressure release at the end of the operation produces a lightening of the vehicle, thus enabling it to rise to the surface again.

This submarine vehicle for dredging and raising nodules, powered by pneumatic energy, cannot readily be guided during its descent or during its movement on the sea bed. Moreover, the pneumatic energy stored in these dredging machines is required both for the dredging itself and for raising the materials collected from the sea bed and the energy yield is very poor.

French patent application No. 77 01288, filed in the name of the Applicant on Jan. 18th 1977, (U.S. Pat. No. 4,231,171) describes another process wherein the energy required for the accurate manoeuvring of the vehicle and for dredging on the sea bed is stored in the machines in a known form, e.g. in the form of electricity, but the energy required for the descent and re-ascent of the vehicle is supplied in the form of potential energy. More precisely, it is produced by a slight excess of ballast to permit descent. This ballast is progressively released as dredging proceeds and the excess ballast still remaining after the dredging operation is released at the end of the operation to make the machine lighter so that it can be raised again. This raising and descent can be accurately guided by the hydrodynamic form of the submarine vehicle which behaves as a "glider" under the excess apparent weight required for the descent or under the excess buoyancy required for re-ascent.

The advantage of this process is that there is a considerable energy saving in all the phases of the operation of collecting and raising the nodules. Propellers supplied with energy for travel on the sea bed are the only ones which operate for any considerable time, whilst the auxiliary manoeuvring propellers are not used very much (only for precise landing manoeuvres on the sea bed and/or for making a rendezvous when returning to the surface).

Moreover, a number of submarine machines or vehicles are known which, at shallow depths, derive their buoyancy from the leaktight seal of the hull and which, for great depths, use buoyancy products resistant to very high pressures, to constitute a "wet submarine". This vehicle comprises, in addition to the resistant sealed capsule in which the passengers are housed if the vehicle is manned, a structure forming a tubular or other form of framework connecting the various weighty parts to one another. The buoyancy product in the form of blocks of small or moderate dimensions is generally fixed to this framework. These wet submarines may or may not comprise a hydrodynamic hull which, if provided, is in the form of a thin hull, but the hull does not, under any circumstances, coincide with the outer surface of the buoyancy product. It will be appreciated that the structures described hereinbefore are a major factor in the balance sheet of apparent weight in water of the submarine machines thus formed. This consequently results in an increase in the mass of buoyancy product required to provide zero or positive buoyancy.

An example of such a vehicle is the one described and claimed in patent application No. 27 29460 filed on Sept. 30th 1977 in the name of the Applicant (U.S. Pat. No. 4,280,288).

BRIEF SUMMARY OF THE INVENTION

This invention relates precisely to an improved submarine vehicle for collecting and raising materials (particularly nodules) which remedies the abovementioned disadvantages.

The dredging and raising machine which is the object of the present invention can be used more particularly for the process mentioned above and relates to a vehicle for descending and re-ascending by means of potential energy transformed into longitudinal propulsion by means of the external hydrodynamic forms of the vehicle, causing it to glide during descent and ascent, whilst its essential function is to move along in contact with the sea bed with the aid of main propellers supplied with stored energy at the same time as this latter energy is activating dredging mechanisms located at the front of said vehicle and over all its frontal width, the abutment and propulsion on the sea bed being obtained by means of said main propellers, which are rotary and cylindrical in form and comprise helical threads located on each side of the vehicle, singly or in pairs.

It is distinguished from the known submarine vehicles for great depths in that it enables substantial quantities of minerals collected on the sea bed to be raised with the maximum ratio between the total mass and the useful load raised. By useful load is meant the load raised, which, for the machines according to the invention, differs as little as possible from the required ballast load taken down, and the difference between the two constitutes the potential energy. By the load is meant the apparent weight in water. As a reminder, it should be pointed out that the known manned submarines for use at great depths can raise, at most, a mass equivalent to 10% of their own mass and the bathyscaph, the float of which is liquid. The vehicle according to the invention can raise at least 30% of its total mass.

To obtain these results according to the invention, the submarine vehicle for collecting and raising materials resting on a sea bed at great depth, which is of the type comprising a load-bearing structure, means for collecting the materials, storage silos for the materials collected and/or for the ballast material, transfer means between said collecting means and said silos, and main propellers for advancing said vehicle on the sea bed, is characterized in that said load-bearing structure is made of a buoyancy material, said structure being in the form of a ring having a longitudinal plane of symmetry and defining the stem, stern and sides of said vehicle and thus defining a free central space, whilst the outer surface of said structure forms the hull of said vehicle, the storage silos being located in the free central space and fixed to said load-bearing structure, said collecting elements being arranged in front of and below said stem, said main propellers being fixed to the lower surface of said load-bearing structure.

According to a preferred feature of the invention, the load-bearing structure is formed by a side-by-side association of modular elements made of a buoyancy material, said modular elements being made integral with one another by assembling elements working under traction, whilst the outer lateral surface of each modular element defines the corresponding portion of the hull.

According to another preferred embodiment, the collecting elements are arranged side by side and take up substantially the whole width of the vehicle; the storage silos are arranged along at least two lines parallel to the longitudinal plane of symmetry of said vehicle and placed symmetrically relative to this plane, each line taking up substantially the entire length of said central space; and said transfer means consist of a first set of conveyors travelling in the direction of the length of the vehicle, each conveyor of the first set being associated with a collecting element, a second set of conveyors consisting of at least two conveyors which are symmetrical relative to said longitudinal plane and adapted to bring towards said longitudinal plane the materials transferred by the conveyors of the first set, and a third set of conveyors consisting of at least two conveyors arranged symmetrically relative to the longitudinal plane and passing above the upper opening of the silos in said lines and enabling said material to be emptied into said silos by gravity.

BRIEF DESCRIPTION OF THE DRAWINGS

In any case, the invention will be more readily understood from the following description of an embodiment of the invention given as a non-restrictive example. The description refers to the accompanying drawings, wherein.

FIG. *2a* is a perspective view of the load-bearing structure which constitutes both the buoyancy member and the hull, FIG. *2b* is a horizontal sectional view of the load-bearing structure, FIG. *2c* is a vertical half-section through the load-bearing structure, FIG. *3a* is a partial longitudinal section through the vehicle showing a main conveyor, FIGS. *3b* and *3c* are details from FIG. *3a*, showing the way in which the pivoting of the buckets of the conveyor is controlled above a silo which is not completely full.

DETAILED DESCRIPTION OF THE PREFERRED EMBODIMENTS

Figure 1:
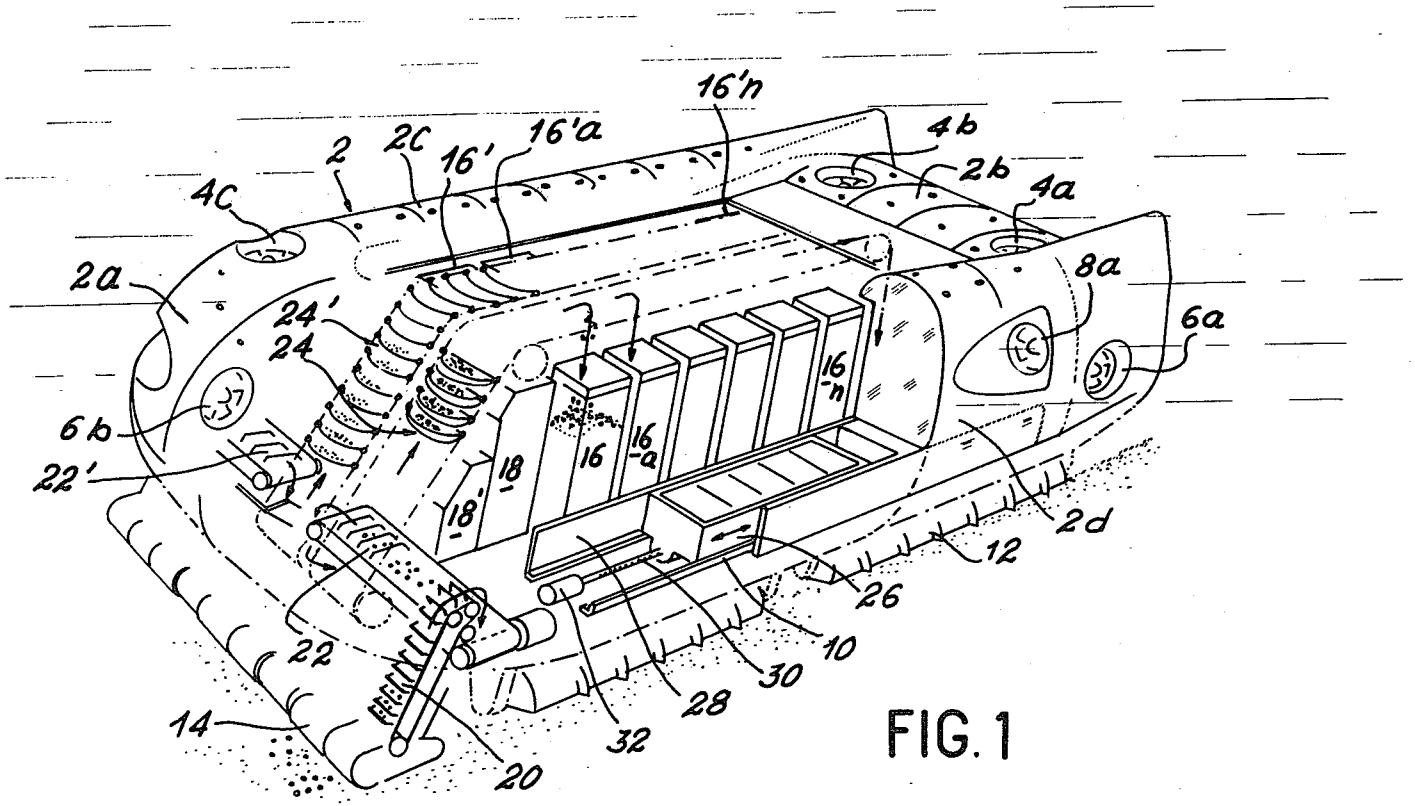
FIG. 1 is a simplified perspective view of the submarine vehicle.

FIG. 1 shows a perspective view, partially stripped away, of the entire vehicle according to the invention. This vehicle comprises a load-bearing structure 2 in the form of a ring, which comprises a frontal portion 2*a* forming the stem, a rear portion 2*b* and two lateral uprights or side walls 2*c* and 2*d*. According to an essential feature of the invention, this load-bearing structure 2 consists of a buoyancy material which is resistant to the high pressures the vehicle has to withstand. It is important to note that the outer surface of the structure 2 constitutes the hull of the vehicle. In this buoyancy material are provided a certain number of orifices for housing the auxiliary propellers of the vehicle to enable the latter to perform certain manoeuvres. On the one hand there are four vertical propellers 4*a*, 4*b*, 4*c* (the fourth propeller is not visible in FIG. 1). There are also lateral propellers such as 6*a* and 6*b*, the other propellers not being visible, and finally longitudinal propellers, of which only the propeller 8*a* is visible. Fixed to the lower surface of the load-bearing buoyancy structure 2 there is an assembling chassis 10, to the lower surface of which are fixed the main propellers for travel along the ground, having the general reference numeral 12. In this particular case, as will be seen more clearly from the other figures, on each side of the vehicle there are four propellers 12 mounted in pairs in a bogie arrangement. These propellers preferably consist of Archimedean screws, as described in French patent application No. 77 01288.

On the front portion of the load-bearing structure 2, there are collecting elements 14 arranged side by side. They are all identical and take up the entire width of the vehicle. These collecting elements 14 may correspond to those already described in French patent application No. 77 29460. Preferably, they are constructed in the manner to be described in connection with FIGS. 5*a* and 5*b*.

In the internal space of the load-bearing structure 2 is housed a set of storage silos for nodules, arranged in two rows parallel to the longitudinal plane of symmetry of the vehicle. These vertical silos have the reference numerals 16, 16*a* . . . 16*n* and, for the other line, 16', 16'*a* . . . 16'*n*. In front of these two lines of silos there are silos bearing the reference numerals 18 and 18' the functioning of which will be explained hereinafter.

The nodules picked up by the collecting means 14 are transferred into the storage silos 16, 16' by three sets of conveyors. First, there is a first series of conveyors 20, each of which is associated with a collecting element 14. These conveyors 20 transfer the materials in a plane parallel to the longitudinal plane. On each side of the plane of symmetry, half the conveyors empty into one of the conveyors 22 and 22'. These two conveyors convey the material in a plane perpendicular to the plane of symmetry of the vehicle. Each of the conveyors 22 recovers the nodules carried by the corresponding half of the conveyors 20. Finally, the nodules transferred by these two conveyors 22 are moved towards a third set consisting of two conveyors 24 and 24' which transfer the nodules from the conveyors 22 into the silos 16, 16'. It will be seen that the upper part of the conveyor 24 or 24' passes above the silos 16 and 16', respectively. The structure of these conveyors and, in particular, the structure of the conveyors 24 and 24' will be described in more detail hereinafter.

The electrical energy required to supply the various propellers and, for example, the drive motors for the conveyors and other associated components which will be described hereinafter is provided by two sets of batteries such as 26 mounted symmetrically on each side of the longitudinal plane of the vehicle. Preferably, these batteries are slidably mounted in a slide structure 28 integral with the lower chassis 10. A screw-nut system activated by a motor 32 enables the set of batteries 26 to be displaced in the longitudinal direction of the vehicle. As will be explained hereinafter, this makes it possible to regulate the horizontal position of the vehicle.

FIGS. 2*a* to 2*c* show the preferred embodiment of the load-bearing structure which constitutes both the hull and the buoyancy member at the same time. As has already been pointed out, this load-bearing structure comprises a front portion 2*a* forming the stem, a rear zone 2*b* which is preferably provided with ailerons 2'*b* and 2''*b* and two longitudinal girders or side walls 2*c* and 2*d*. In fact, these structures are modular, as can be seen best in FIG. 2*b*. Each of these four elements consists of an assembly of modular elements having the general reference numeral 40. These modular elements comprise, on their contact surface, either a projecting portion 40 or a recessed portion 42'. The various modular elements 40 which make up one of the four elements 2*a* to 2*d* are joined together by means of horizontal tie-rods 44 and 46. Tie-rods are also used to connect the four portions of the load-bearing structure to one another. Obviously, the profile of each modular element 40 is adapted to the outer shape of the hull which is to be formed and to the internal recesses as to provide the internal space in which the storage silos and the conveyors are placed. Moreover, as has already been explained, some of these modular elements 40 comprise bores which enable the various propellers to be put into position, in particular. FIG. 2*c* schematically shows the connection between these various elements of the load-bearing structure 2 and the assembling chassis 10. Again, the connection is made using tie-rods which are vertical and have the reference numeral 48, these tie-rods being fixed to the chassis 10 at their lower end. In the modular elements there are recesses to enable batteries 26 to be implanted, in particular. The chassis 10 essentially assembles the main Archimedean screw propellers 12, the storage silos 16 and 16' to one another and fixes the whole to the load-bearing structure 2.

Each modular element 40 of the load-bearing structure, which simultaneously forms the buoyancy member, may advantageously be made from an agglomerated material which is pressure-resistant. This material may consist of hollow glass beads between which beads of larger diameter may be agglomerated. Each modular element may be moulded. It should be added that, to prevent the introduction of excessive concentrations of stresses resulting from the tie-rods, suitable volumes of elastomer to distribute the stresses may be applied between the contact surfaces.

If one studies the whole of the load-bearing structure 2, it will be seen that its general shape is flattened and has an optimum aerodynamic drag coefficient $C_x$, a very high aerodynamic drift coefficient $C_z$ and a moderate aerodynamic lift coefficient $C_y$. It will be appreciated that the load-bearing structure thus formed makes it possible to get as close as possible to the overall buoyancy centre and the centre of gravity of the vehicle as a whole. In fact, a structure in which the heavy parts were located towards the bottom and the light parts near the top would have a very high hydrostatic return couple applied by the water on the vehicle when inclined relative to its normal. Now, to enable the vehicle according to the invention to descend, one must be able to give the vehicle a substantially negative longitudinal position during this phase, whilst this position may be up to 45°. The positive return couple has to be sufficiently low to ensure that 10% excess ballast placed at the front during descent is capable of bringing about the required inclined angular position of about 45°. This arrangement is therefore optimal for providing the limited transverse and longitudinal stability, on the one hand, and also, since the storage silos occupy a central position, the couples resulting from defects in the lateral or longitudinal symmetry of the useful load or couples applied by loads on the vehicle tending to change the position of the vehicle are minimised as much as possible. The manner in which the silos are filled will be explained hereinafter.

As an example, thanks to the assembling of elemental modules, the load-bearing structure and hence the entire vehicle can be made with very large volumes. The width of the vehicle may be up to 12 meters, the length 30 meters and the height 7.50 m.

It will also be appreciated that, thanks to the load-bearing structure according to the invention as described above, total removal of all the other components (the propeller on the ground 12, the battery 26, the silos 16, 16' and 18, the conveyor elements, the collecting elements 14) can easily be effected by simply lifting them vertically. The assembling chassis 10 only provides the resistance required during the assembly and maintenance of the vehicle.

The various essentially heavy and/or mechanical elements mentioned above are distributed, thanks to the annular arrangement of the load-bearing structure, in such a way that the substantial masses are not placed too low in this structure. For this purpose, the batteries 26 may be placed below the load-bearing structure, as described, or, depending on the distribution of the masses, placed above the longitudinal girders 2*c* and 2*d*. With the exception of the batteries 26 (which constitute about 50 tonnes of the 800 tonnes of the loaded machine), if they are placed at the upper part, it will be seen that all the heavy components are arranged below the load-bearing structure and permanently exert traction on the modules 40 of the load-bearing structure which constitutes the hull.

Figure 3A:
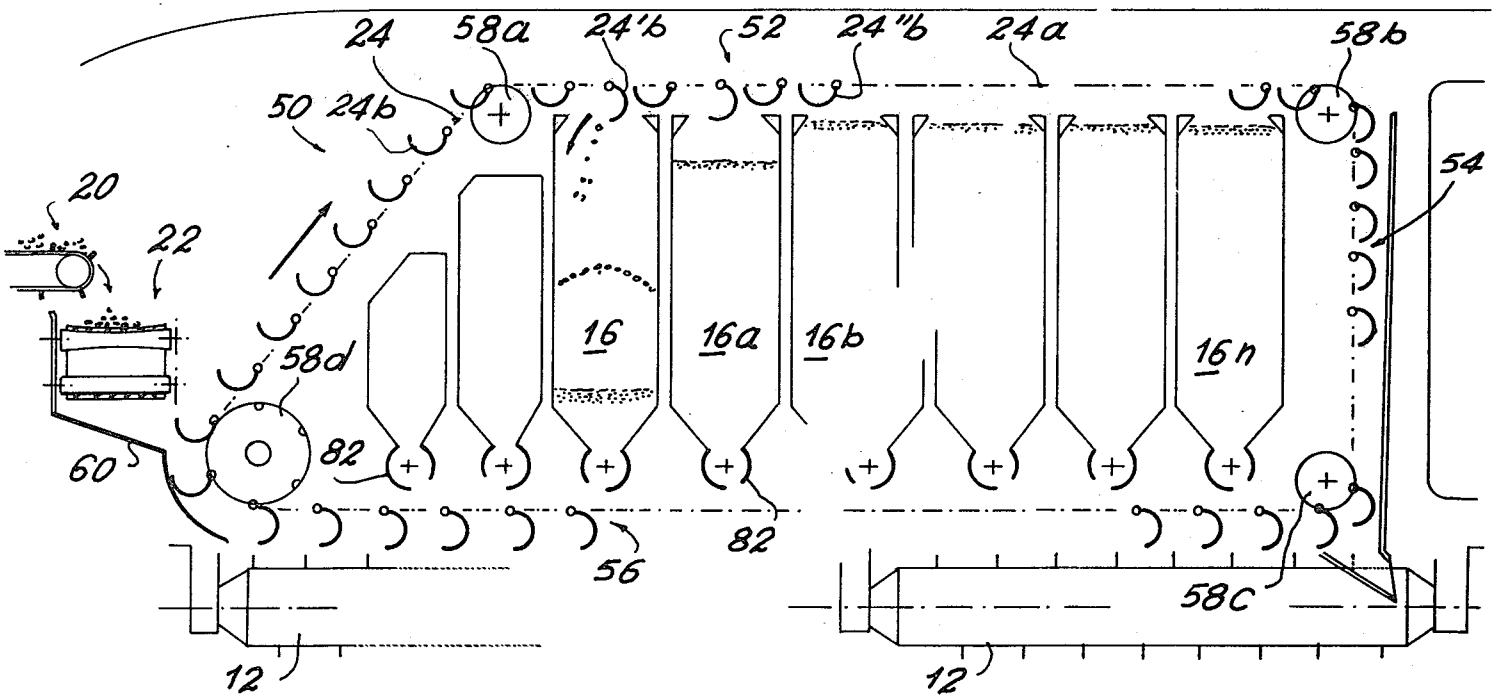
Figure 3B:
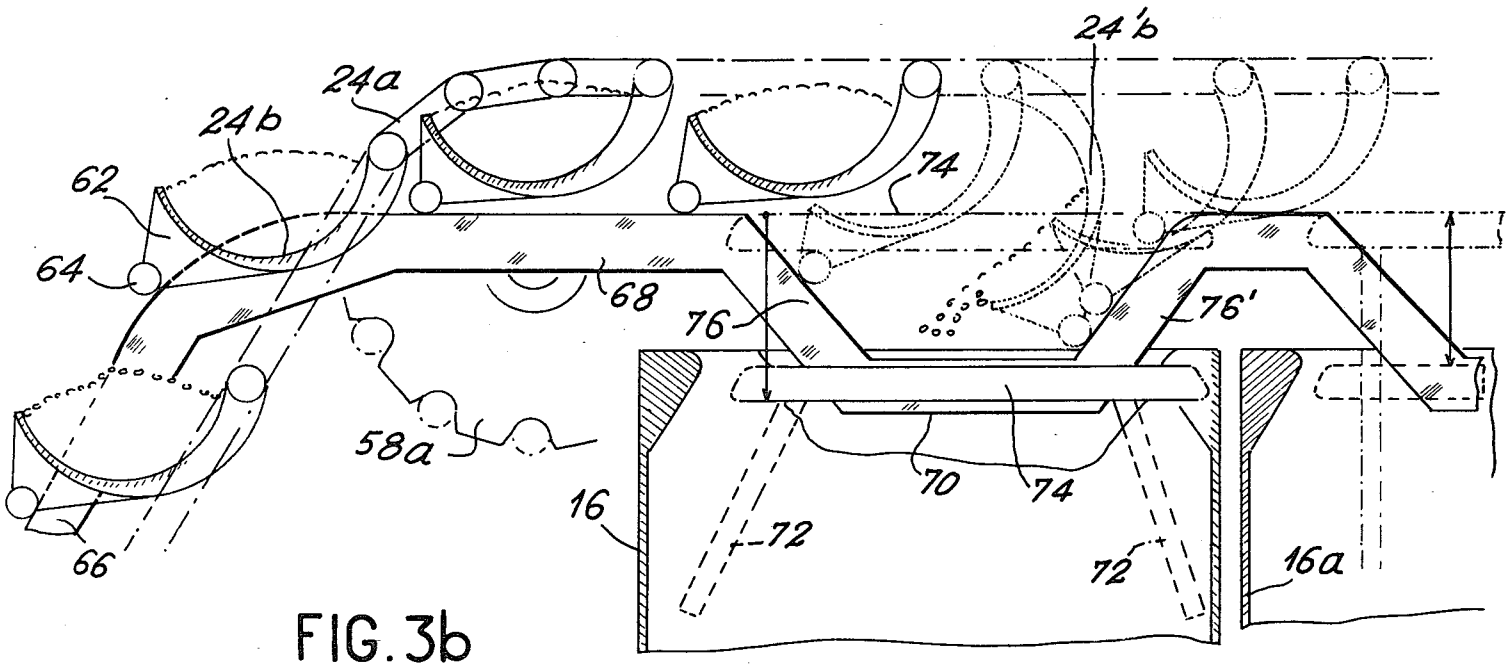
Figure 3C:
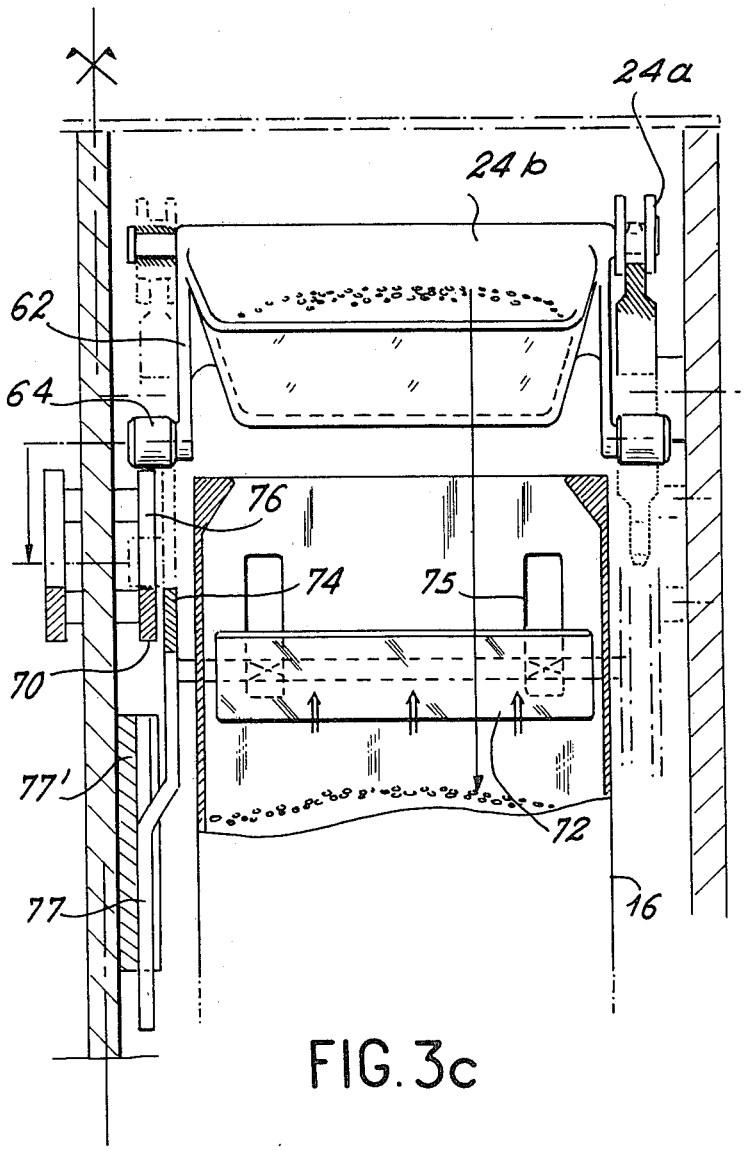

FIGS. 3*a* to 3*c* show the construction and method of operation of the conveyor 24 for filling the silos. This conveyor preferably consists of two parallel belts (only the belt 24*a* being visible) on which buckets such as 24*b* are pivotally mounted. The path of the conveyor 24 comprises a loading phase 50, a loading phase with horizontal displacement 52, a descending phase 54 and a return phase 56. These different phases are defined by return pulleys 48*a*, 58*b* and 58*c* and by a drive wheel 58*d* activated by a motor (not shown).

In the simplified FIG. 3*a*, it is shown that the buckets 24*b* remain in a horizontal position during the ascending phase 50, thus retaining the nodules, by moving from a loading spout 60 arranged below the conveyor 22 to the horizontal path 52. When a bucket passes over the first unfilled silo, for example silo 16, the bucket pivots (bucket 24'b) to pour its load into the corresponding silo by gravity. After this pivoting, the bucket 24'b remains in the same position and is not straightened up again until position 24''b above the full silo 16b. It pivots again beyond the wheel 58b.

The detailed FIGS. 3b and 3c show a method of activating these buckets to ensure that the nodules are actually poured out as indicated. The figure shows that each bucket 24b is provided on its outer surface with a rod 62 having a roller 64 at its free end. In the region corresponding to the ascending phase 50, an inclined ramp 66 is mounted parallel to the path of the conveyor 24. This ramp is arranged so that the roller 64 which abuts on the ramp 66 holds the bucket 24b in a horizontal position ensuring that the nodules are retained. Beyond the pulley 58a this ramp 66 is followed by a horizontal ramp 68 which ensures that, when the roller 64 is abutting on this ramp 68, the buckets are kept in the horizontal position.

In line with each silo which is to be filled with the nodules, the ramp 68 has an offset portion 70 connected to the ramp 68 by inclined portions 76, 76'. Each storage silo 16, 16a . . . and 16', 16'a . . . comprises two movable ramp portions 74 to which are fixed two inclined flaps 72 and 72'. The two ramp portions 74 and the flaps 72 and 72' define between them an opening for filling the silos. The two ramp portions 74 are integral with guide rods 77 held in guides 77'.

The flaps 72 are fixed to the guides 77 through ports 75 provided in the wall of the silo. When the corresponding silo 16 or 16' is not full, the ramp portions 74 are in the lowered position and connected to the ramp 68 by inclined planes 76. Consequently, when the bucket 24b arrives in line with the first non-filled silo, the roller 64 comes into contact with the inclined portions 76 and the movable ramp 74 and the bucket 24b is thus made to pivot and empty its contents into the silo. On the other hand, when the corresponding silo 16 or 16' is full, the inclined flaps 72 are raised by the filling of nodules in the silo, so that the guide ramp portion 74 comes into alignment with the rest of the guide ramp 68. Thus, when a new bucket 24b comes level with the full silo 16 or 16', the ramp on which the roller 64 abuts does not have any discontinuity at this level. There is a slight dipping of the movable ramp 74, causing only a very slight emptying of nodules from the bucket. Thus complete pivoting will only occur in line with the first silo where the corresponding ramp portion 74 is in the lowered position.

Figure 4:
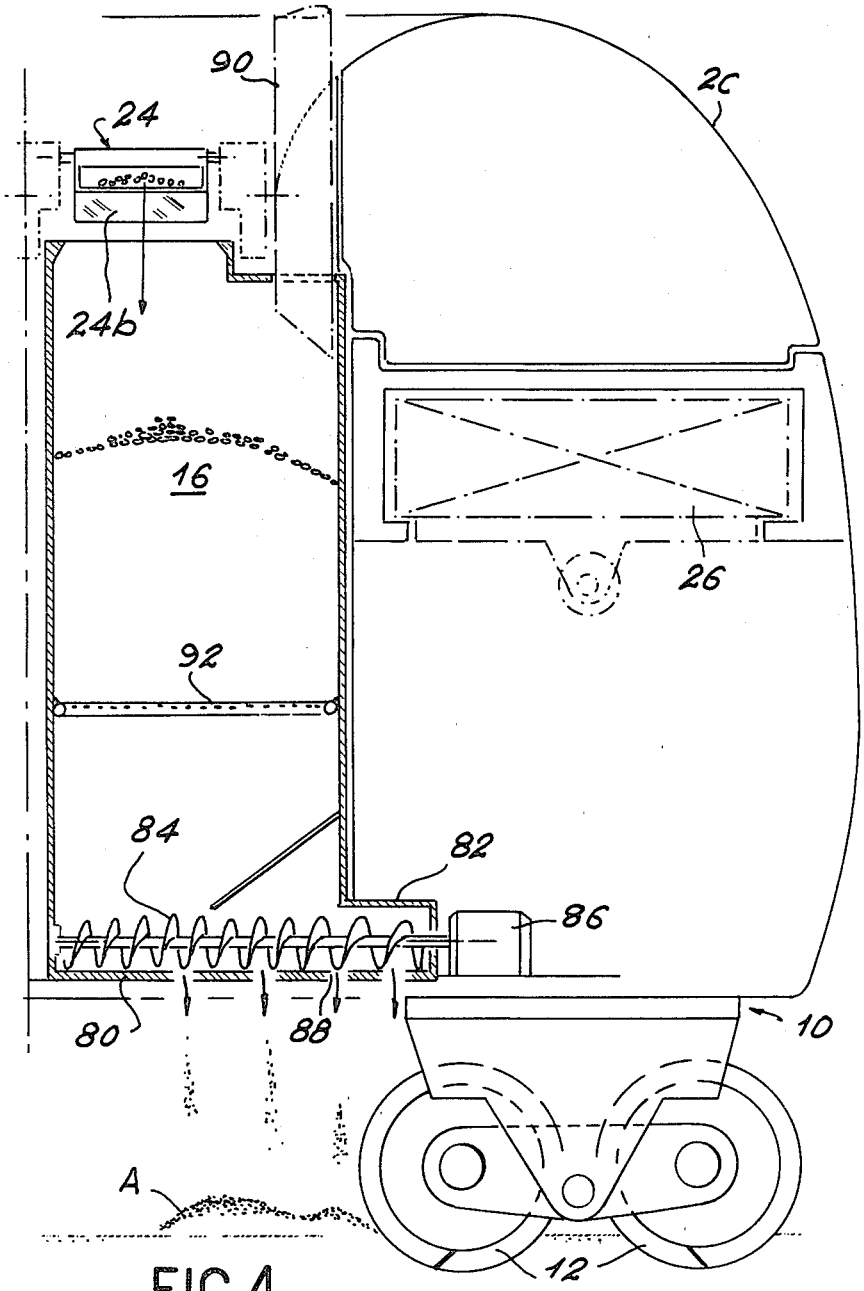
FIG. 4 is a vertical half-section through the vehicle, showing the structure of a storage silo for nodules and/or ballast, FIG. *5a* is a simplified perspective view of a collecting element, and FIG. *5b* is a vertical section through the collecting element in FIG. *5a*.

As has already been pointed out, the descent and ascent of the vehicle are effected by varying the apparent weight thereof, this apparent weight being regulated by ballast consisting of sterile ore contained in or removed from the storage silos. FIG. 4 shows precisely the apparatus for evacuating the sterile material stored in a storage silo 16 or 16' before this silo is filled with the nodules collected. To this end, as can be seen from FIG. 4 the silos 16 comprise at their lower end, a base 80. The silo is extended by a tube 82 arranged perpendicularly to the longitudinal plane of symmetry of the vehicle. An Archimedean screw 84 is housed above the base 80 and continues into the duct 82. This screw is driven by a motor 86 fixed to the end of the screw, as shown in FIG. 4. The base 80 and the tube 82 are provided with orifices 88 through which the sterile material can escape so as to unload the ballast. These orifices 88 are arranged so that the sterile ballast released, shown by the references A, spreads substantially over half the width of the vehicle so as to result in good distribution of the unloaded sterile ballast. It should be noted that the sterile material (see the patents cited) may be obtained from the processing of nodules and may take the form of a high density sludge. The silo 16 comprises at its upper end a duct 90 for loading with sterile material and, near the bottom, each silo has a water injection duct 92 for converting the compacted sludge into a fluidised sludge which can be evacuated and distributed by the Archimedean screws 84. Thus, the release of ballast can be controlled separately for each silo.

Figure 5B:
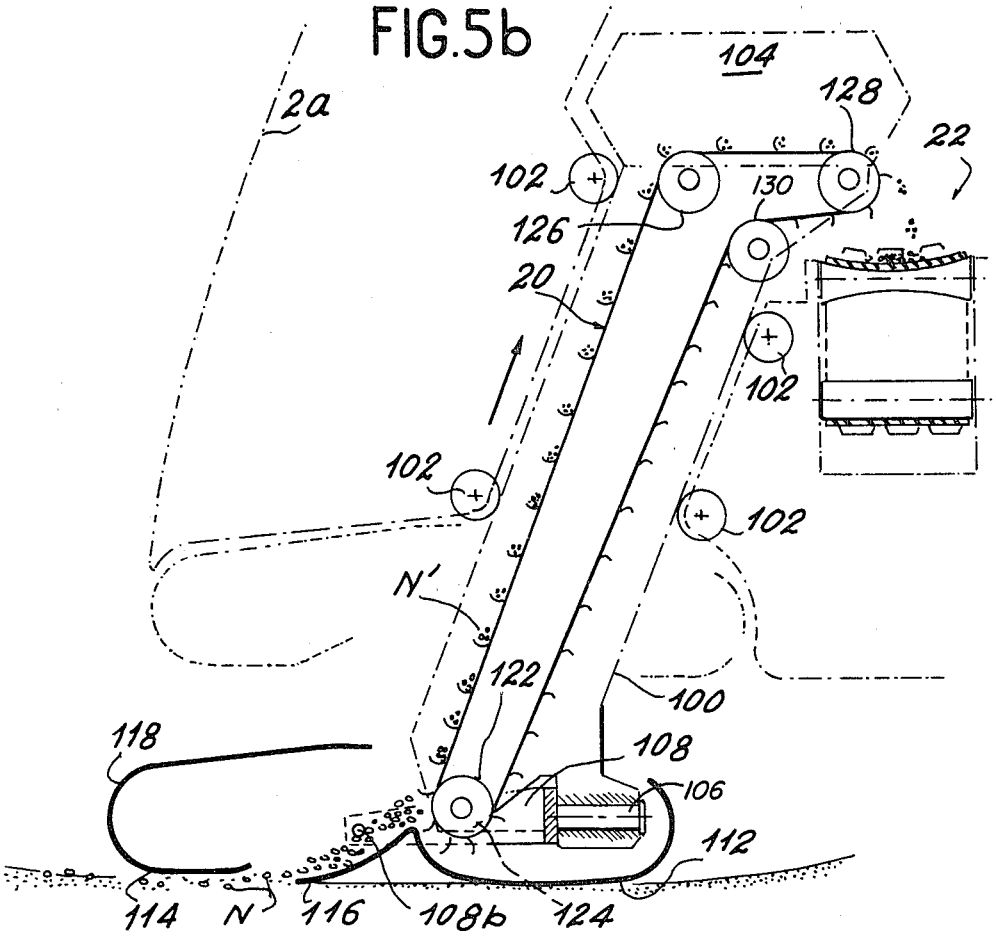
Figure 5A:
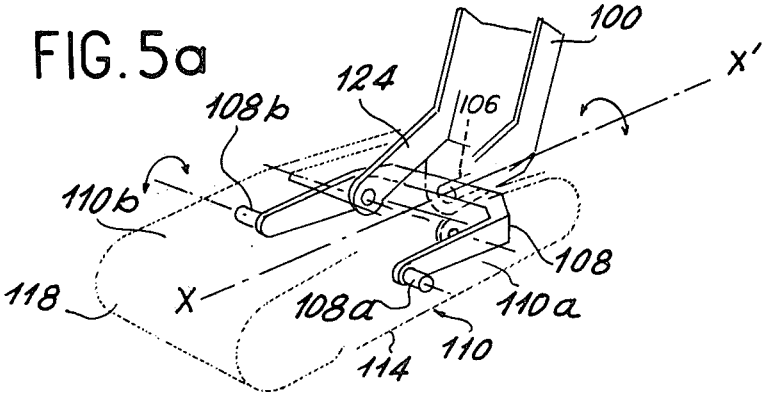

As has already been indicated, nodules are collected from the sea bed by means of a certain number of individual collecting elements 14 which take up substantially the entire width of the vehicle. In view of the fact that the sea bed may have local uneven areas, it is advantageous to provide collecting elements which can adapt to these uneven parts as accurately as possible. In fact, to ensure a certain collecting rate, all the collecting elements must conform to the profile of the sea bed. With this purpose, FIGS. 5a and 5b show a preferred embodiment of the collecting elements 14.

Each element 14 is mounted by a universal joint at the bottom end of two rods 100. The rods are slidably mounted relative to the load-bearing structure 2 via a certain number of guide rollers such as 102. Moreover, a buoyancy element 104 is fixed to the top end of the rods 100. At their bottom end, the rods 100 are connected by a crosspiece 106 in which a fork 108 is pivotally mounted about the axis XX'. The ends 108a and 108b of the fork 108 are mounted so as to swivel in the side walls 110a and 110b of the body 110 of the collecting element 14. As is shown more clearly in FIG. 5b, the body 110 comprises a rear base 112 and a front base 114 separated by a recess. In this recess there is a nodule collecting rake 116 which is inclined. The body 110 comprises at the front a hull 118 connected to the base 114.

At the exit from the rake 116, known mechanical or hydrodynamic means drive the nodules N towards the lower part of the conveyor 20 associated with the collecting element. N' shows a nodule placed in a bucket 20a of the conveyor 20.

A roll 122 over which the conveyor 20 passes is rotatably mounted in parts 124 integral with the bottom end of the rods 100. The conveyor 20 also passes over return rollers 126, 128 and 130 which are pivotally mounted relative to the rods 100. One of these rollers serves to drive the conveyor 20 and is associated with a motor (not shown).

Beyond the roller 128, the nodules fall on to one of the conveyors 22 and 22'.

The method of operation of a collecting element 14 is as follows. Thanks to the fact that the rods 100 are able to slide relative to the load-bearing structure 2 and thanks to the universal-joint mounting of the collecting elements 14 relative to the rods 100 as mentioned above, the rakes 116 and the surfaces 114 and 112 adapt to the surface of the sea bed. Moreover, the buoyancy element 104 makes it possible to compensate for the apparent weight of the collecting element with its conveyor, so as to adapt the bearing pressure to a suitable value on the sediment on the sea bed. In fact, this sediment will only withstand a very small unit load, to permit suitable sliding of the "sledge" consisting of the body 110 of the collecting element. Moreover, the abutment zone 112 (at the rear of the dredging zone) completes the thrust on the ground exerted by the front abutment zone 114. This abutment surface makes it possible to withstand a certain apparent weight of the dredging assembly via the universal-joint mounting, during dredging.

As an example, each collecting element may have a width of the order of one meter, and the vehicle comprises twelve identical assemblies, six of which are associated with the conveyor 22 whilst the other six are associated with the conveyor 22'.

With regard to the foregoing description of the preferred embodiment of the vehicle, its method of operation will now be described.

Near the surface station, some of the storage silos are filled with sterile material as follows: silos 16*a* to 16*n* and 16'*a* to 16'*n* are filled with sterile material, as is the silo 18, until the vehicle has a neutral weight, measured by dynamometry of its reactions on the surface station. The weight of equilibrium is adjusted by means of the last silos located near the centre of gravity, whilst the silo 16 remains empty. The silo 18' at the extreme front is then filled, the excess weight of which will cause the vehicle to descend. Furthermore, regulating the position of the sets of accumulators makes it possible to adjust the vehicle's angular position for the descent. If required, the trajectory of descent can be adjusted by means of the vertical auxiliary propellers. Before landing, moving back the batteries and possibly partially evacuating the extreme front silo will restore the horizontal position, and the shape with a high $C_z$ coefficient ensures a soft landing, and the propellers are started up.

Once the vehicle is resting on the sea bed, the dredging elements are lowered, as is well known, by means of raising and lowering devices (not shown in FIG. 5*b*) which make it possible, in particular, to raise the collecting elements during vertical movements of the vehicle to improve its hydrodynamic characteristics and dredging is carried out at the same time. The action of the collecting elements 14 has already been described. However, it should be noted that, in the case of a collecting element not operating, the rake 116 can be inclined rearwards, which does not prevent the element from sliding over the surface of nodules which have not been collected. Thus, the failure of a collecting element results only in loss of production, but does not stop the vehicle.

As they are collected, the nodules are carried away by the conveyors 20 and brought by the conveyors 22 and 22' to the entrance to the main conveyors 24 and 24'. These conveyors successively fill the empty silos, as has been explained in conjunction with FIGS. 3*a* and 3*c*. Simultaneously, and one silo in advance, the sterile ballast sludge is emptied from the silos, so that they can be filled with nodules. This emptying is effected by the Archimedean screws. The apparent weight of the vehicle is kept at a substantially constant value.

It should be added that, even if there is a difference between the quantity of nodules graded by the collecting elements associated with the conveyor 24, compared with those associated with the conveyor 24', total filling of the silos is nevertheless obtained. In fact, the conveyor associated with the line of silos already filled continues to operate, rejecting the nodules collected beyond the pulley 58*b* (FIG. 3*a*), whilst the other conveyor finishes filling the other line of silos. Thus, the transverse lie of the vehicle is maintained as constant as possible.

When all the silos have been filled, the ballast is emptied from the front silos 18 and 18', thus providing, on the one hand, a negative apparent weight so that the vehicle can re-ascend, and on the other hand establishing the desired positive position of the vehicle for the ascent. This taking up of the inclined position may be completed by moving the sets of accumulators 26 towards the rear.

The foregoing description shows that the vehicle according to the invention has numerous advantages over those of the prior art. Some of its component parts perform a number of functions.

The load-bearing structure also constitutes the buoyancy element and the hull of the vehicle required for its "gliding", whilst the accumulators additionally act as a balancing mass to provide the longitudinal position of the vehicle for the descent and ascent phases. Finally, the storage silos are used both for ballast and for storage of the nodules.

Moreover, the vehicle permits the maximum load of nodules in relation to its "unladen" weight. The collecting elements ensure efficient collection of nodules, even if the sea bed is uneven. Finally, the means for transferring the nodules to the storage silos ensure total filling of the silos without causing any transverse imbalance of the vehicle, in spite of statistical variations in the density of the nodules on the sea bed over which the vehicle travels.

The invention is not limited to the embodiments described and represented hereinbefore and various modifications can be made thereto without passing beyond the scope of the invention.

What is claimed is:

1. A submarine vehicle for collecting and raising materials resting on the sea bed at great depths, of the type comprising a load-bearing structure (2), collecting elements (14) for the materials, storage silos (16) for storing the materials collected and ballast material, transfer means (20, 22, 24) between said collecting elements and said silos, and main propellers (12) for advancing the vehicle on the sea bed, wherein said load-bearing structure (2) is made of a buoyancy material, said structure being in the form of a ring having a longitudinal plane of symmetry and defining the stem (2*a*) stern (2*b*) and sides (2*c*, 2*d*) of said vehicle, thus defining between them a free central space, the outer surface of said structure forming the hull of said vehicle, said storage silos (16) being arranged in the free central space and fixed to said load-bearing structure, said collecting elements (14) being arranged in front of and below said stem (2*a*), said main propellers (12) also being fixed to the lower surface of said load-bearing structure, wherein the load-bearing structure (2) is formed by the side-by-side arrangement of modular elements (40) made of a buoyancy material, said modular elements being made integral with one another by tie rods (44, 46) while the outer lateral surface of each modular element defines the corresponding portion of the hull wherein said collecting elements (14) are arranged side-by-side and take up substantially the entire width of the vehicle, said storage silos (16) are arranged in at least two lines (16, 16') parallel to the longitudinal plane of symmetry of said vehicle and placed symmetrically relative to this plane and having upper openings, each line taking up substantially the entire length of said free central space, and wherein said transfer means consist of a first set of conveyors (20) moving in the longitudinal direction of the vehicle, each conveyor of the first set being associated with a collecting element (14), a second set of conveyors consisting of at least two conveyors (22) symmetrical relative to said longitudinal plane and adapted to move towards said longitudinal plane the material transferred by the conveyors of the first set (20), and a third set of conveyors consisting of at least two conveyors (24) arranged symmetrically with respect to the longitudinal plane and passing above the upper opening of the silos in said lines (16, 16') and enabling said material to be emptied into said silos by gravity.

2. A vehicle according to claim 1, wherein each silo (16) comprises at its bottom end means (84, 88) for evacuating the ballast with which it is initially filled.

3. A vehicle according to claim 1, comprising, in the front portion of the free central space, silos (18) adapted to receive ballast for the descent of the vehicle and adapted to discharge this ballast for the ascent of the vehicle.

4. A submarine vehicle for collecting and raising materials resting on the sea bed at great depths, of the type comprising a load-bearing structure (2), collecting elements (14) for the materials, storage silos (16) for storing the materials collected and ballast material, transfer means (20, 22, 24) between said collecting elements and said silos, and main propellers (12) for advancing the vehicle on the sea bed, wherein said load-bearing structure (2) is made of a buoyancy material, said structure being in the form of a ring having a longitudinal plane of symmetry and defining the stem (2*a*) stern (2*b*) and sides (2*c*, 2*d*) of said vehicle, thus defining between them a free central space, the outer surface of said structure forming the hull of said vehicle, said storage silos (16) being arranged in the free central space and fixed to said load-bearing structure, said collecting elements (14) being arranged in front of and below said stem (2*a*), said main propellers (12) also being fixed to the lower surface of said load-bearing structure, wherein the load-bearing structure (2) is formed by the side-by-side arrangement of modular elements (40) made of a buoyancy material, said modular elements being made integral with one another by tie rods (44, 46), while the outer lateral surface of each modular element defines the corresponding portion of the hull wherein said collecting elements (14) are arranged side-by-side and take up substantially the entire width of the vehicle, said storage silos (16) are arranged in at least two lines (16, 16') parallel to the longitudinal plane of symmetry of said vehicle and placed symmetrically relative to this plane and having upper openings, each line taking up substantially the entire length of said free central space, and wherein said transfer means consist of a first set of conveyors (20) moving in the longitudinal direction of the vehicle, each conveyor of the first set being associated with a collecting element (14), a second set of conveyors consisting of at least two conveyors (22) symmetrical relative to said longitudinal plane and adapted to move towards said longitudinal plane the material transferred by the conveyors of the first set (20), and a third set of conveyors consisting of at least two conveyors (24) arranged symmetrically with respect to the longitudinal plane and passing above the upper opening of the silos in said lines (16, 16') and enabling said material to be emptied into said silos by gravity comprising two lines of storage silos (16, 16') wherein the second and third sets of conveyors each comprise two conveyors (22, 22'; 24, 24'), each conveyor of the third set moving above a line of silos, each conveyor of the third set and each silo being provided with means (64, 74, 76) to ensure that said material can only be emptied into a non-filled silo (16) which is encountered in the direction of travel of the conveyor (24).

5. A vehicle according to claim 4, wherein said conveyors of the third set (24) are of the bucket type, the buckets (24*b*) being pivotally mounted relative to the belts (24*a*) of each conveyor, each bucket comprising a roller (64) adapted to cooperate with a ramp (66, 68) parallel to the path of said conveyor, said ramp having offset portions (70) in line with each silo (18) to enable said buckets to pivot, each silo being provided with a movable ramp portion (74) adapted to take up a raised position extending said ramp (66, 68) and a lowered position level with said offset portions (70), said ramp being provided on its inner surface facing the silo, with means (72) for bringing said ramp portion into the raised position when the silo is full.

6. A submarine vehicle for collecting and raising materials resting on the sea bed at great depths, of the type comprising a load-bearing structure (2), collecting elements (14) for the materials, storage silos (16) for storing the materials collected and ballast material, transfer means (20, 22, 24) between said collecting elements and said silos, and main propellers (12) for advancing the vehicle on the sea bed, wherein said load-bearing structure (2) is made of a buoyancy material, said structure being in the form of a ring having a longitudinal plane of symmetry and defining the stem (2*a*) stern (2*b*) and sides (2*c*, 2*d*) of said vehicle, thus defining between them a free central space, the outer surface of said structure forming the hull of said vehicle, said storage silos (16) being arranged in the free central space and fixed to said load-bearing structure, said collecting elements (14) being arranged in front of and below said stem (2*a*), said main propellers (12) also being fixed to the lower surface of said load-bearing structure, wherein the load-bearing structure (2) is formed by the side-by-side arrangement of modular elements (40) made of a buoyancy material, said modular elements being made integral with one another by tie rods (44, 46) while the outer lateral surface of each modular element defines the corresponding portion of the hull wherein said collecting elements (14) are arranged side-by-side and take up substantially the entire width of the vehicle, said storage silos (16) are arranged in at least two lines (16, 16') parallel to the longitudinal plane of symmetry of said vehicle and placed symmetrically relative to this plane and having upper openings, each line taking up substantially the entire length of said free central space, and wherein said transfer means consist of a first set of conveyors (20) moving in the longitudinal direction of the vehicle, each conveyor of the first set being associated with a collecting element (14), a second set of conveyors consisting of at least two conveyors (22) symmetrical relative to said longitudinal plane and adapted to move towards said longitudinal plane the material transferred by the conveyors of the first set (20), and a third set of conveyors consisting of at least two conveyors (24) arranged symmetrically with respect to the longitudinal plane and passing above the upper opening of the silos in said lines (16, 16') and enabling said material to be emptied into said silos by gravity comprising two sets of accumulators of electrical energy (26), each set being arranged symmetrically relative to the longitudinal plane, each set being mounted on means for translational displacement (30) in the direction of said longitudinal plane.

7. A submarine vehicle for collecting and raising materials resting on the sea bed at great depths, of the type comprising a load-bearing structure (2), collecting elements (14) for the materials, storage silos (16) for storing the materials collected and ballast material, transfer means (20, 22, 24) between said collecting elements and said silos, and main propellers (12) for advancing the vehicle on the sea bed, wherein said load-bearing structure (2) is made of a buoyancy material, said structure being in the form of a ring having a longitudinal plane of symmetry and defining the stem (2*a*) stern (2*b*) and sides (2*c*, 2*d*) of said vehicle, thus defining between them a free central space, the outer surface of said structure forming the hull of said vehicle, said storage silos (16) being arranged in the free central space and fixed to said load-bearing structure, said collecting elements (14) being arranged in front of and below said stem (2*a*), said main propellers (12) also being fixed to the lower surface of said load-bearing structure, wherein the load-bearing structure (2) is formed by the side-by-side arrangement of modular elements (40) made of a buoyancy material, said modular elements being made integral with one another by tie rods (44, 46) while the outer lateral surface of each modular element defines the corresponding portion of the hull wherein said collecting elements (14) are arranged side-by-side and take up substantially the entire width of the vehicle, said storage silos (16) are arranged in at least two lines (16, 16') parallel to the longitudinal plane of symmetry of said vehicle and placed symmetrically relative to this plane and having upper openings, each line taking up substantially the entire length of said free central space, and wherein said transfer means consist of a first set of conveyors (20) moving in the longitudinal direction of the vehicle, each conveyor of the first set being associated with a collecting element (14), a second set of conveyors consisting of at least two conveyors (22) symmetrical relative to said longitudinal plane and adapted to move towards said longitudinal plane the material transferred by the conveyors of the first set (20), and a third set of conveyors consisting of at least two conveyors (24) arranged symmetrically with respect to the longitudinal plane and passing above the upper opening of the silos in said lines (16, 16') and enabling said material to be emptied into said silos by gravity wherein each collecting element (14) consists of a collecting body mounted by a universal joint at the bottom end of two support rods (100) which are slidably mounted relative to said load-bearing structure (2), said collecting body being provided with a rake (116) adapted to collect the materials from the sea bed.

8. A vehicle according to claim 7, wherein said collecting body comprises a first abutment surface (114) arranged in front of said rake and a second abutment surface (112) arranged behind said rake (116) relative to the direction of movement of the vehicle, and wherein said rods (100) are provided at their top end with a buoyancy element (104) adapted to reduce the bearing pressure of said surfaces when the materials are picked up.

* * * * *